US008142338B2

(12) United States Patent
Johnson

(10) Patent No.: US 8,142,338 B2
(45) **Date of Patent: *Mar. 27, 2012**

(54) METHODS AND DEVICES FOR TREATING PATHOLOGICAL CONDITIONS OF THE HUMAN KNEE

(76) Inventor: Lanny L. Johnson, Okemos, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/165,044

(22) Filed: Jun. 21, 2011

(65) Prior Publication Data

US 2011/0251531 A1 Oct. 13, 2011

Related U.S. Application Data

(63) Continuation of application No. 12/603,440, filed on Oct. 21, 2009, now Pat. No. 7,998,046.

(60) Provisional application No. 61/107,604, filed on Oct. 22, 2008.

(51) Int. Cl.
*A63B 23/00* (2006.01)
*A63B 21/002* (2006.01)

(52) U.S. Cl. ..... 482/148; 482/91

(58) Field of Classification Search ..... 482/91, 482/128–129, 121, 148; 601/27; 5/648–650
See application file for complete search history.

(56) References Cited

U.S. PATENT DOCUMENTS

| | | | | |
|---|---|---|---|---|
| 2,132,862 | A | 10/1938 | Pilates | 482/122 |
| 3,120,954 | A | 2/1964 | Apostol | |
| 3,985,127 | A | 10/1976 | Volkov et al. | |
| 4,372,299 | A | 2/1983 | Fixel | 602/24 |
| 4,502,170 | A | 3/1985 | Morrow | 5/632 |
| 4,542,900 | A | 9/1985 | Ray | |
| 4,700,373 | A | 10/1987 | Miller | 378/177 |
| 4,805,605 | A | 2/1989 | Glassman | 602/24 |
| 4,862,605 | A * | 9/1989 | Gardner et al. | 36/43 |
| 5,046,487 | A | 9/1991 | Scott | 601/27 |
| 5,222,311 | A | 6/1993 | Lin | |
| D360,796 | S | 8/1995 | Goldado | D6/601 |
| 5,579,591 | A * | 12/1996 | Kousaka et al. | 36/31 |
| 5,687,742 | A | 11/1997 | Johnson | |
| 6,032,669 | A | 3/2000 | Klein | 128/845 |
| 6,179,756 | B1 | 1/2001 | Bertolucci et al. | 482/91 |
| 6,725,578 | B2 * | 4/2004 | Kerrigan | 36/144 |
| 6,726,642 | B2 | 4/2004 | Danielsson et al. | 602/5 |
| 6,745,501 | B2 | 6/2004 | Brown | |
| 7,036,169 | B2 | 5/2006 | Marshall | 5/650 |
| 2004/0198570 | A1 | 10/2004 | Tanglos | 482/111 |
| 2005/0020417 | A1 | 1/2005 | Gary | 482/140 |
| 2006/0217248 | A1 | 9/2006 | Diseati | 482/128 |

* cited by examiner

*Primary Examiner* — Fenn Mathew
(74) *Attorney, Agent, or Firm* — David J. Dawsey; Michael J. Gallagher; Gallagher & Dawsey Co., LPA

(57) ABSTRACT

Kit and method for treatment or rehabilitation of medical conditions of the human knee using an apparatus having a substantially rigid support member having two substantially similar sides joined at one end, which forms an apex, and having a third side including two opposing linear surfaces separated by a cavity; an adjustable strap; and a wedged insole.

11 Claims, 6 Drawing Sheets

METHODS AND DEVICES FOR TREATING PATHOLOGICAL CONDITIONS OF THE HUMAN KNEE

CROSS REFERENCE TO RELATED APPLICATIONS

This application is a continuation of U.S. patent application Ser. No. 12/603,440 filed on Oct. 21, 2009, now U.S. Pat. No. 7,998,046, which claims benefit of priority to U.S. patent application Ser. No. 61/107,604 filed on Oct. 22, 2008, the contents of which are herein incorporated by reference in their entirety.

FIELD OF THE INVENTION

The present invention relates generally to a system of treatments for pathological conditions of the human knee accompanying injury, surgery, or osteoarthritis with resultant articular injury, muscle weakness, contracture, bowleg deformity and knock-knee deformity and more specifically to rehabilitation methods and devices that straighten the alignment of a knee and strengthen the musculature while providing a dynamic alteration in forces during weight bearing that protect such a knee's joint surfaces.

BACKGROUND OF THE INVENTION

A variety of adverse knee conditions are prevalent among the patient population including a variety of knee injuries and osteoarthritis (OA). The nature of knee injuries varies widely including injury to ligaments, bone, meniscus and most importantly the articular or gliding cartilage of the joint surface. Although the purpose of knee surgery is to improve the function of the joint, it too creates an insult in the process. Therefore following injury, surgery or disease like osteoarthritis a rehabilitation protocol and process are instituted to provide optimal recovery. Just as in surgery, rehabilitation uses methods and devices to accomplish restoration of function and quality of life. As in surgery there are precise protocols and order of interventions to achieve an optimal result. The goals of rehabilitation are typically to restore motion, increase flexibility of such a knee and optimize muscle strength while protecting the articular surfaces. Rehabilitation often involves stretching exercises and workouts with weights. Both are often performed with traditional gym equipment, which is not particularly tailored to injuries of the knee. For example, weight machines and floor stretches may increase muscle and add flexibility while not addressing the lack of knee extension, the medial or lateral capsular and ligamentous contracture so essential to optimal rehabilitation and recovery. In addition, the protection of injured joint surfaces so common to injury, surgery and disease are often excluded from the rehabilitation process.

U.S. Pat. No. 5,687,742 provides a knee extension device that includes an L-shaped configuration having an elongated body portion and a lower leg support member. The subject's leg is positioned on the body member with the lower portion of the leg resting on the support member. Pressure is selectively applied to the leg to gradually force the knee towards a straight ended position. While this device may effectively straighten the knee it does not operate to strengthen the muscles, such as weakened quadriceps musculature. Accordingly, the subject must again workout with weights to regain strength to the surrounding muscles that affect the knee. Thus, the subject must use multiple devices or machines for treatment and risks irritation or injury to the knee when building muscle. As such, there remains a need to develop improved rehabilitation methods and devices that address all aspects of the process in an optimal order; correct the contractures, optimize the musculature, and protect the injured or disease joint surfaces during the process and during weight bearing of walking.

OA is the pathological condition manifested by articular cartilage softening, fissures, fragmentation and ultimately loss of the thickness of the gliding cartilage that covers the joint surface. This loss results in narrowing of the space between the bones of the knee with subsequent angulation of the tibia on the femur. Loss of cartilage predominately from the medial compartment results in bowleg deformity and similar loss of cartilage from only the lateral compartment results in knock-knee deformity. Persistence of either angulation deformity results in more force translated through the compromised compartment of the knee during walking causing progressive loss of articular cartilage. The progressive arthritis results in knee pain, limp, and loss of activities of daily living, sport and work. Over time there is secondary tightening of the soft tissues which becomes permanent and is known as a contracture. The contracture which may be medial, lateral or posterior may require surgical correction.

Those affected with such knee injuries or arthritis may have loss of ability to straighten their knee plus either bowleg or knock-knee will have difficulty walking due to the abnormal alignment. This will cause difficulty with activities of daily living, restriction from sports, and loss of work. Further, these conditions are often accompanied by weakened quadriceps musculature that further impedes function. This muscle weakness is propogated by the knee flexion deformity and the lack of use due to pain. The loss of muscle strength compounds the medical disability. Thus, in some instances treatment of such injuries or conditions may actually require a combined approach that addresses both the joint as well as the resulting weakening of the quadriceps muscle.

There are a variety of ways to accomplish correction of knee contracture, weakness of the quadriceps femoris muscles and symptoms of early arthritis of the knee such as bowleg or knock-knee deformity, including many cumbersome and expensive devices, health care provider implemented physical therapy and even surgery. However, each has significant drawbacks including inconvenience of availability, high costs and further medical risks to the patient.

Accordingly, there remains a need to develop non-surgical devices that are inexpensive and easy to use by those suffering from medical conditions affecting the knee. Further, there remains a need to develop such devices for the convenience of home therapy.

BRIEF SUMMARY OF THE INVENTION

The present invention addresses the need to provide non-surgical home therapeutic methods and devices to correct conditions of the knee following injury, disease or surgery to address knee contracture, bowleg deformity and knock-knee deformity, muscle weakness, joint surface injury or arthritis. Further, the present invention provides methods that passively correct fixed contracture, strengthen the quadriceps femoris muscles, while protecting the compromised joint surfaces during weight bearing and walking which assists in preventing further injury to the knee and strengthens the knee itself.

The rationale for this method and these devices is based upon the principle that passive correction of contracture or deformity must precede opportunity for active or dynamic correction to occur.

In one aspect of the present invention a method for passive and active exercises of the human knee is provided. The method includes the use of an apparatus, including a substantially rigid support member having two substantially similar sides joined at one end, which forms an apex, and having a third side including two opposing linear surfaces separated by a cavity; and an adjustable strap. The apparatus is interchangeable between two configurations. In a first configuration, a passive exercise embodiment, the apparatus provides a system for comfortably stretching the capsule and soft tissue about the knee. In this configuration either of the substantially similar sides rests against a surface or ground while the cavity extends generally upwards. The subject places the affected leg across the cavity, resting on the two opposing surfaces; secures the leg to the support member via the adjustable strap(s); and intermittently and progressively tightens the strap(s) to the lower extremity, above and below the knee towards the cavity thereby gradually straightening the knee. In a second configuration the support member is flipped over on its third side; the subject places the affected lower extremity so the knee is over the apex; secures the ankle or shin to the support member using the adjustable strap; and periodically raises the leg upwards against the tension of the strap, thereby performing an active isometric exercise affecting the quadriceps muscle.

In some instances, such as OA, the knee problem is accompanied by a bowleg or knock-knee deformity. Accordingly, in further embodiments the present invention provides methods of preventing or correcting the mal-alignment of a subject's lower extremity suffering from a condition such as bowleg or knock-knee deformity. The method includes the use of a spacer, preferably constructed from foam or combination of materials with a soft material covering and an adjustable strap. Passive correction of bowleg deformity is performed by placing the spacer between the subject's ankles or feet and periodically tightening the strap around the knees to bring the knees inward. Once the patient's condition is passively corrected, the subject may continue treatment by releasing the strap and with the spacer still in position, actively tightening the adductor muscle (inner groin) of the inner thigh to pull the thighs and knees together. Over time by this method passive correction will achieved.

Correction of knock-knee deformity is performed by placing the spacer between the subject's knees and periodically tightening the strap around the ankles or feet thereby bringing the feet together. Once the patient's condition progresses the subject may remove the spacer and with the strap still in position and with legs as straight as possible, actively tighten the abductor muscles (hip muscle) of the outer thigh to pull the thighs and knees apart, thereby further stretching the previously contracted outer knee soft tissues.

Once the passive correction is achieved and maintained the opportunity for active or dynamic correction is possible during ambulation with use of force altering devices like shoe insoles of specific design and materials.

By selectively relieving pressure or unloading either the lateral compartment or medial compartment during activity of weight bearing or walking an opportunity is provided for cartilage repair. This potential result is based upon medical literature showing spontaneous repair with unloading the knee or hip joint, even of minimal amounts over time. It is likely the presence of cartilaginous aggregates, small islands of repair cartilage proliferate in the unloaded environment and repair the articular surface. In some embodiments treating a bowleg deformity results in additional cartilage or cartilage aggregates formed in the medial compartment of the knee. In other embodiments treating a knock-knee deformity results in additional cartilage or cartilage aggregates formed in the lateral compartment of the knee.

BRIEF DESCRIPTION OF THE DRAWINGS

FIG. 2A demonstrates extending the subject's leg over the cavity 18 of the rigid support member 11 and securing the subjects leg using two adjustable straps 22. The subject's leg rests on the two opposing surfaces 20. In FIG. 2B the adjustable straps 22 are tightened, which brings the subject's knee towards the cavity 18 of the support member 11.

DETAILED DESCRIPTION OF THE PREFERRED EMBODIMENTS

Figure 1:
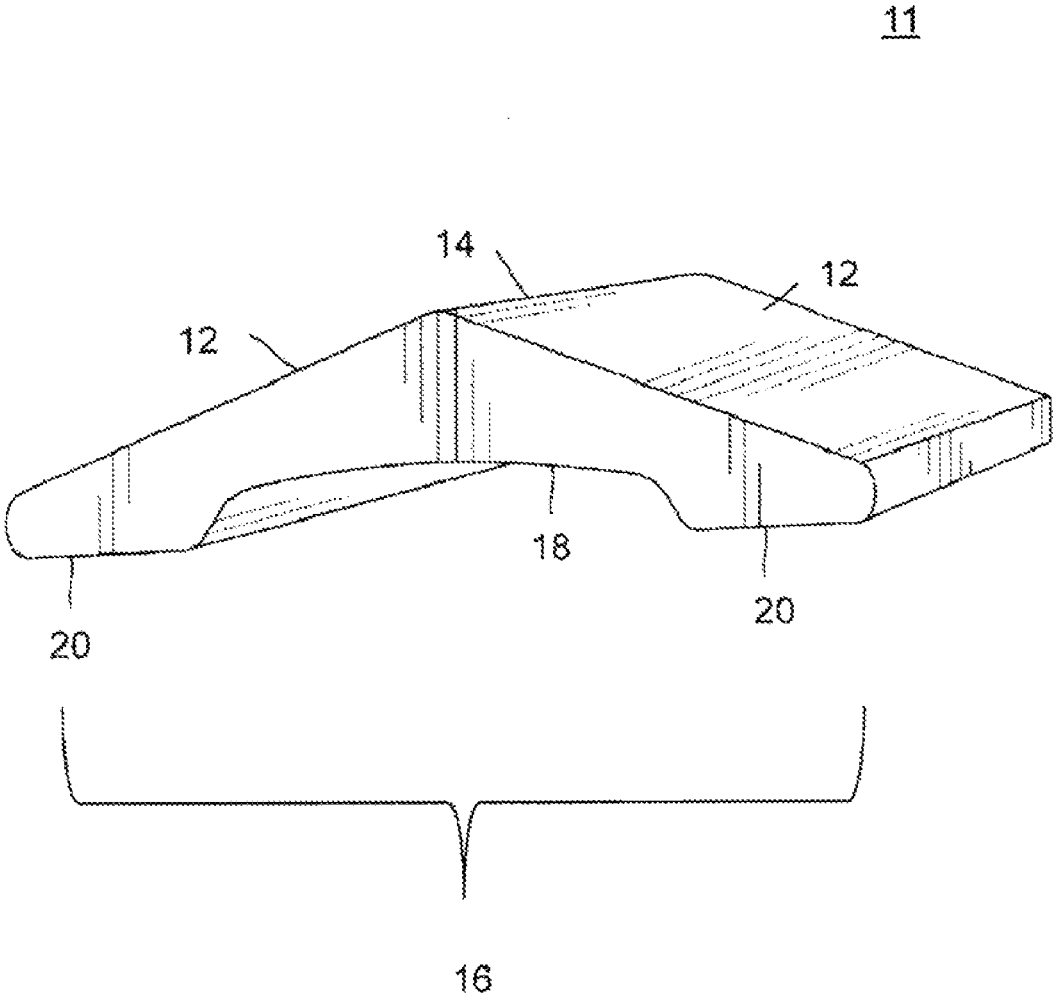
FIG. 1 is a perspective view of a rigid support member 11 having two substantially similar sides 12 joined at an apex 14 and a third side 16 having a cavity 18 positioned between two opposing linear surfaces 20.

Methods and apparatuses provided herein treat patients suffering from a variety of medical conditions or injuries affecting the knees. Among these include osteoarthritis (OA), knee contracture, weakness of the quadriceps, bowleg deformity and knock-knee deformity, or those requiring post operative rehabilitation.

In developing such apparatuses and methods, it is an object of the present invention to provide apparatuses and methods that are non-surgical, for personal use at home, or in conjunction with physical therapy, simple to use and can be efficiently produced.

It is another object the invention to provide devices and methods that provide dual purpose exercises or dual treatments thereby reducing or eliminating the need for multiple devices for straightening and strengthening the lower extremities.

I. Passive and Active Exercise to Treat Pathological Conditions the Knee

Loss of the ability to straighten the knee and loss of muscle strength are common results of osteoarthritis (OA) or following injury or surgery. The loss of motion may be either or both of the inability to straighten the leg (extension) and the inability to bend the knee (flexion). Loss of knee extension is easily demonstrated with the person sitting on the floor with their lower extremities both out in front of them. The loss of extension will be obvious in that the back of the knee will not touch the floor. Loss of knee flexion can be easily demonstrated by sitting on the floor and actively pulling both heels up to the buttocks. Any loss of knee flexion will be evident by the affected limb's heel being further away from the buttock. Most people, even those with moderate degenerative arthritis, can straighten their knee fully and bend their knee more than 90 degrees and have their heel come within 6 inches of the buttocks. Any thing less is a reason for concern and consideration of diagnosis and treatment.

In a first aspect of the present invention a method for passive and active exercise for pathological conditions of the human knee is provided. The method will have particular use for those in rehabilitation after surgery of the knee, including total knee surgery, knee ligament surgery or fracture about the knee joint. Further, the methods will have particular utility for those suffering from OA. Each of which can have significant loss of extension, contractures and muscle loss. Referring collectively to FIGS. 1-3B, the method includes use of an apparatus, which includes a substantially rigid support member 11 being substantially triangular in shape or generally V-shaped, with two substantially similar sides 12 angularly joined at an apex 14 and a longer third side 16 having a cavity 18 positioned generally about its center. By providing the cavity 18, two opposing surfaces 20 of the third side 16 remain linearly aligned, which provide benefits as discussed below. The apparatus also includes at least one adjusting strap 22 and in preferred embodiments includes two adjusting straps 22. The apparatus is interchangeable between two configurations. A first provides an embodiment for passive exercise, which may include a stretching exercise to extend a subject's knee suffering from a condition such as an arthritic knee or knee contracture. A second configuration provides an embodiment for active isometric exercise of the quadriceps, such as to build or maintain muscle in the quadriceps after suffering from a medical condition associated with the knee or leg, such as arthritic knee or knee contracture following injury or surgery.

Figure 2A:
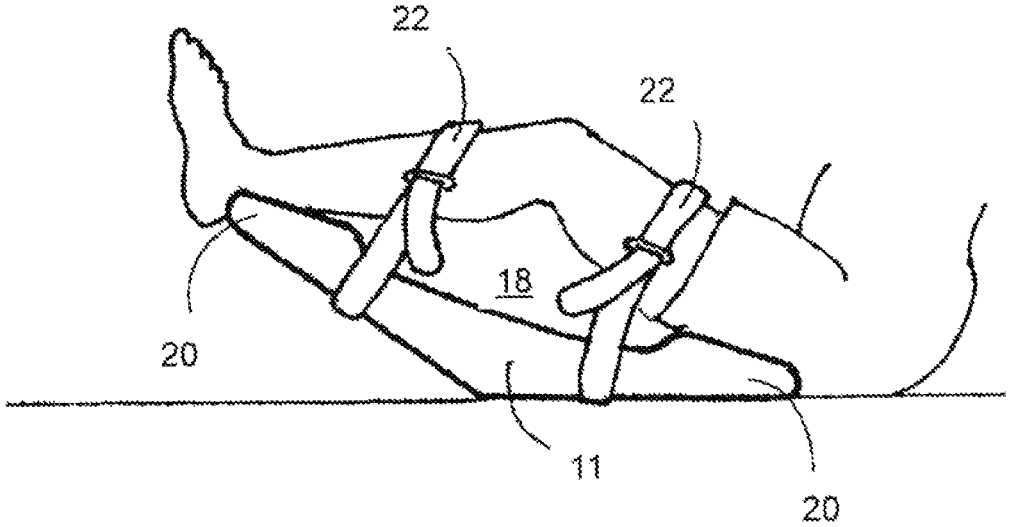
FIGS. 2A and 2B are diagrams depicting passive stretching of the knee for the treatment of knee contracture or knee injury.
Figure 2B:
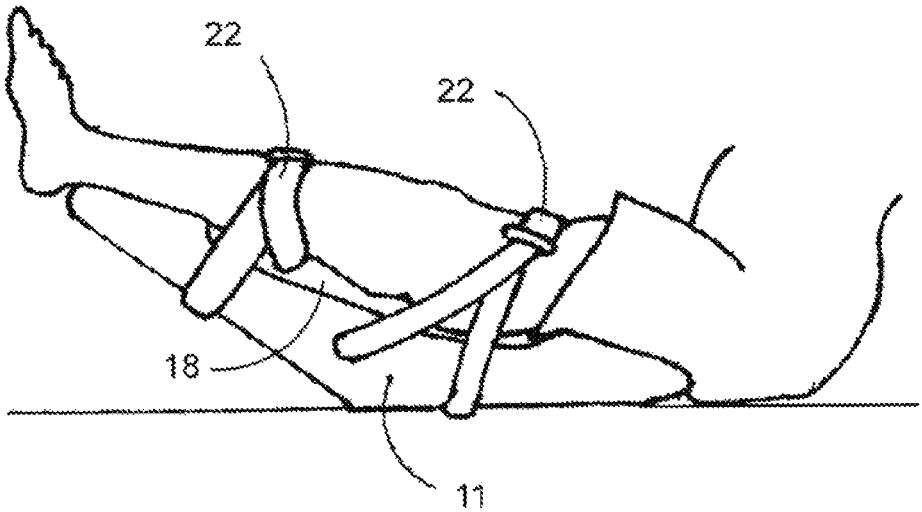

In the first configuration, the cavity 18 faces generally upwards. Referring to FIG. 2A, the subject's legs are placed over the cavity 18 and at least one strap 22, but preferably two, are positioned around the rigid support member 11 and the subject's leg. The two opposing surfaces 20, which flank the cavity 18, provide regions for resting both the proximal and distal ends of the leg and thus further ensure the subject does not slip off of the support member 11 when securing or tightening the straps 22. In preferred embodiments a first adjustable strap 22 is positioned around the patient's shin and a second adjustable strap 22 is positioned around the patient's quadriceps. Referring to FIG. 2B, the straps 22 are periodically tightened, which lowers the knee towards the cavity 18. Periodic tightening and thus lowering of the knee results in increased extension of the subject's knee and thus treats conditions such as knee contracture following injury or surgery.

In the second configuration the rigid support member 11 is oriented such that the cavity 18 faces generally downwards, which lays the rigid support member 11 on its third side 16. Thus, in the second configuration the opposing surfaces 22 flanking the cavity 18 act as a base to stabilize the support member 11. Accordingly, the apex 14 extends generally upwards. The subject's knee is position over the apex 14 and the shin is loosely secured to the support member 11 using an adjustable strap 22. The subject periodically raises 25 the foot against the tension of the strap 22, which results in an active isometric exercise of the quadriceps. Accordingly, the active isometric exercise increases muscle mass in the quadriceps and thus provides an effective treatment while protecting the knee joint from any potential adverse effects of motion.

In each configuration the rigid support member 11 provides the primary support or base for the apparatus and thus can be made of any suitable material for its purpose, such as rigid foam, wood, plastics, metals, polystyrenes, with rigid foam material such as STYROFOAM being preferred. The angle at the apex 14, which joins the two substantially similar sides 12, may be any suitable angle for the proportion, comfort or exercise level of the user. Preferably, the angle is between about 90 degrees and 170 degrees, and more preferably about 130 degrees. The apex 14 may be rounded or flat, wherein the angle is the real or imaginary angle between the two substantially similar sides 12. Extending outward from the apex 14, the two substantially similar sides 12 are each preferably linear and are of about equal proportions that would properly allow a subject to sit on or at one end, position the knees over the apex 14, and allow the legs to rest at or near the opposing end. A third side 16 includes a cavity 18, which is preferably longitudinal or oblong in shape. The cavity 18 may be formed using any suitable technique, such as injection molding and the like or by cutting away or removing material. The cavity 18 is preferably at least a few inches deep.

A variety of adjustable straps 22 may be used with the present invention including a variety of adjusting cords, ropes and the like coupled with a variety of buckles, slides, snaps, hooks and the like. In preferred embodiments, the adjustable strap 22 is nylon webbing with an adjustment slide or buckle. The length of the adjustable strap 22 may be any suitable length or width and may vary depending on the size of the rigid support member 11. The adjustable strap 22 should be sufficient to wrap around the support member 11 and the subject's affected leg as described herein and as shown in the drawings. In alternative configurations the adjustable strap 22 is integral to the rigid support member 11 or is fed through loops, a throughbore or slot extending through the rigid support member 11. The adjustable strap 22 may include padding for additional comfort.

A treatment method for a subject suffering from knee contracture or an arthritic condition of the knee is also provided, which includes placing either of the two substantially similar sides 12 of the support member 11 on a surface, extending the subject's leg along the third side 16 and over the cavity 18, securing the leg to the support member 11 using the adjustable strap(s) 22, and periodically tightening the strap(s) to lower the knee towards the cavity 18. The two opposing surfaces 20 that flank the cavity 18 provide a support for both the distal and proximal ends of the subject's leg.

Referring to FIGS. 2A-2B, since the rigid support member 11 is substantially symmetrical; the support member 11 can be used from either direction to achieve the same result. After repeated testing the following recommendations and observations are provided. Since the straps 22 are secured around the leg and the support member 11 it may be desirable to position the straps 22 under the support member 11 prior to extending the subject's leg across the cavity 18. This may ease securing of the straps 22. Tightening the straps 22 more and more over time, the knee gradually moves towards the cavity 18, which allows space for the contours of the thigh and calf. It is important for the straps 22 to not be over tightened or tightened too quickly, which can cause pain. The subject should not feel very uncomfortable or feel significant pain; however, the subject will likely feel tightening underneath the knee. It is preferably that the straps 22 be periodically tightened, such as every few minutes, and once the limit of the subject's flexibility has been reached to stay in that position for about 10 minutes. Eventually over time, there should be improvement in extension and flexibility. After repeating this passive straightening exercise over time, the subject should be able to sit on a flat surface with legs extending outward with the back of the knee touching the floor. After straightening has been achieved, the exercise should be also repeated periodically to avoid a relapse. Since muscle weakness is often associated with decreased flexibility, the subject may combine the extension exercises with the strength exercises, such as those that add stability to the knee joint.

Figure 3:
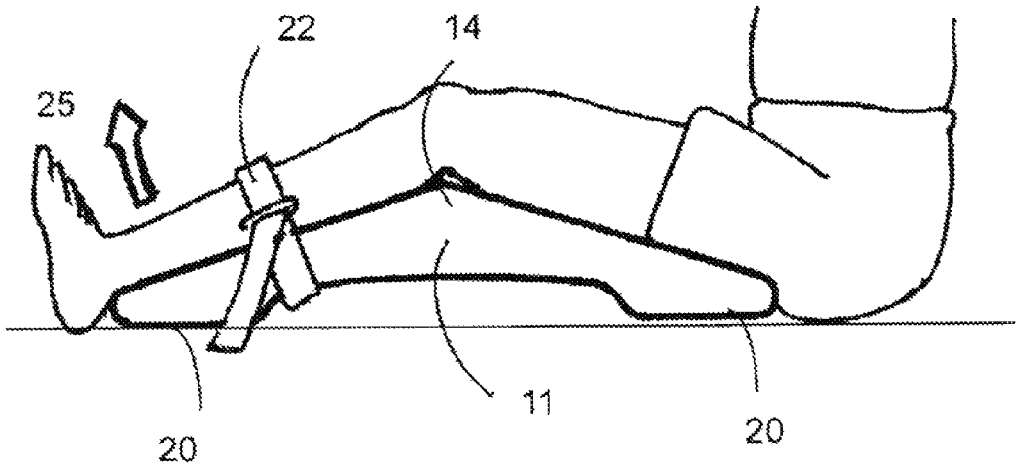
FIG. 3 is a diagram depicting an active isometric exercise of a subject's quadriceps muscle. The rigid support member 11 lies on its third side 16 (on the opposing surfaces 20) and the subject's knee or leg is positioned over the apex 14. An adjustable strap 22 secures or aligns the subject's shin with the support member 11, while the subject lifts the foot upwards 25 against the tension of the adjustable strap 22.

The important muscle for strength or stability of the knee joint is the quadriceps femoris muscle. It is the muscle on the front of the thigh, which when contracted, pulls on the knee cap and straightens the knee by lifting the leg and foot. In another embodiment of the present invention, a method of strengthening the quadriceps of a subject is provided. Referring to FIG. 3, the method includes placing the support member 11 such that the opposing surfaces 20, which are separated by the cavity 18, contact a surface thereby pointing or extending the apex 14 generally upwards, extending the subject's leg over the support member 11 such that the knee is positioned over the apex 14, securing the leg to the support member 11 at about the shin or ankle with the adjustable strap 22, and repeatedly lifting and lowering the leg to tighten and relax the quadriceps muscle. Because the rigid support member 11 is substantially symmetrical, the apparatus can be used from either direction to achieve the same result.

Although many variations exist for positioning the device and subject, placing the strap 22 under the rigid support member 11 prior to placement the subject's leg along the top typically facilitates the process of securing the leg. It is important the strap 22 be snug, but not too tight as to cause major discomfort or pain. It is preferably that the subject gradually tighten the quadriceps muscles for 10 seconds and then relax them for 10 seconds and repeat the process for about 10 repetitions. This type of exercise is known as isometric, in which the muscle stays the same length. In this manner the knee cap is not moved or irritated as with exercises performed with dead weight lifts or machines. Improvement in the muscle mass may be measured by using a tape measure around the thigh three inches above the top of the knee cap.

II. Realignment of Bowleg and Knock-Knee Conditions

A bowleg condition occurs when there is loss of cartilage cushion between the bones in the medial compartment (inner side) of the knee. The result is abnormally increased spacing between the knees when a person pulls the feet and ankles together. Most people with OA have loss of cartilage in the medial compartment of the knee, resulting in outward angulation of the lower extremity or bowleg. If left untreated, the deformity progresses because the angulation is uncompensated, and with each step, the deformity is promoted by an outward thrust of the knee. In medical terms, this is called a varus force. It means the thigh is moving away from the midline of the body while the tibia or lege angles inward which promotes increased bowleg deformity. Overtime, the deformity becomes permanent. If so, the ligament and tissues on the inner side of the knee, which are at first lax, then accommodate to the new position and become tight, which produces a fixed deformity of the knee.

A knock-knee condition occurs when there is loss of cartilage cushion between the bones in the lateral compartment (outer side) of the knee. The knee joint moves towards the other knee and as a result the feet are farther apart. Some people with OA have this loss of cartilage in the lateral compartment, resulting in inward angulation of the lower extremity or knock-knee. If left untreated, the deformity progresses because the angulation is uncompensated, and with each step, the deformity is promoted by an inward thrust of the knee. In medical terms, this is called a valgus force. It means the thigh is moving toward the midline of the body as the leg and foot go outward. The knee moves toward the midline which promotes increased knock-knee deformity. Overtime, the deformity becomes permanent. If so, the ligament and tissue on the outer side of the knee, which are at first lax, then accommodate to the new position and become tight, which produces a fixed deformity of the knee.

Accordingly, in another aspect of the present invention a method and apparatus is provided for use as a treatment for arthritic conditions of the knee and conditions referred to as bowleg and knock-knee. The apparatus includes a spacer 31 and an adjustable strap 32. The spacer 31 may be any suitable size or construction but is preferably about five inches to about twelve inches long, about two inches to about six inches wide, and about one half inch to about two inches deep. Preferably the spacer 31 is symmetrical such that the patient is not required to determine a specific frontwards or backwards orientation. In other words, because the spacer 31 is substantially symmetrical, the spacer 31 can be used from either direction to achieve the same result. The spacer may be provided in any suitable shape for its use but a shape having parallel surfaces, whether front and back, side and side or top and bottom would be preferred. As will become apparent parallel surfaces will help the subject retain the positioning of the spacer either between the knees or between the ankles In preferred embodiments the spacer 31 is constructed from foam, a foam covered material or a soft material, most preferably foam. Non-limiting examples of foams include open cell foams, closed cell foams, a combination of each, polyurethanes and the like. Preferably the foam spacer is sufficiently rigid that a typical user does not fully collapse the opposing surfaces. Preferably, the foam is also sufficiently soft for comfort of the subject. In embodiments utilizing polyurethane foam, the type of polyurethane foam can be, for example, elastomers, including, EPM (ethylene propylene rubber, a copolymer of ethylene and propylene) and EPDM rubber (ethylene propylene diene rubber, a terpolymer of ethylene, propylene and a diene-component), Epichlorohydrin rubber (ECO), Polyacrylic rubber (ACM, ABR), Silicone rubber (SI, Q, VMQ), Fluorosilicone Rubber (FVMQ), Fluoroelastomers (FKM, and FEPM) Viton, Tecnoflon, Fluorel, Aflas and Dai-El, Perfluoroelastomers (FFKM) Tecnoflon PFR, Kalrez, Chemraz, Perlast, Polyether Block Amides (PEBA), and Chlorosulfonated Polyethylene (CSM). One skilled in the art will recognize a foam covered material such as a rigid or semi-rigid block having a foam coating may also be used and is thus included within the present invention. Preferably the spacer is lightweight to reduce or minimize additional strain when conducting the exercise.

The adjustable strap 32 may be fashioned from cords, ropes and the like coupled with a variety of buckles, slides, snaps, hook and loop (VELCRO), and the like. In preferred embodiments, the adjustable strap 32 is nylon webbing with an adjustable slide or buckle. The length of the adjustable strap 32 may be any suitable length or width and may vary depending on the size of subject and the like. Preferably, the adjustable strap 32 is greater than about two feet in length. The strap 32 may be shared for use with the rigid support member 11, when provided in a comprehensive kit for the treatment of knee conditions with the rigid support member 11.

Figure 4A:
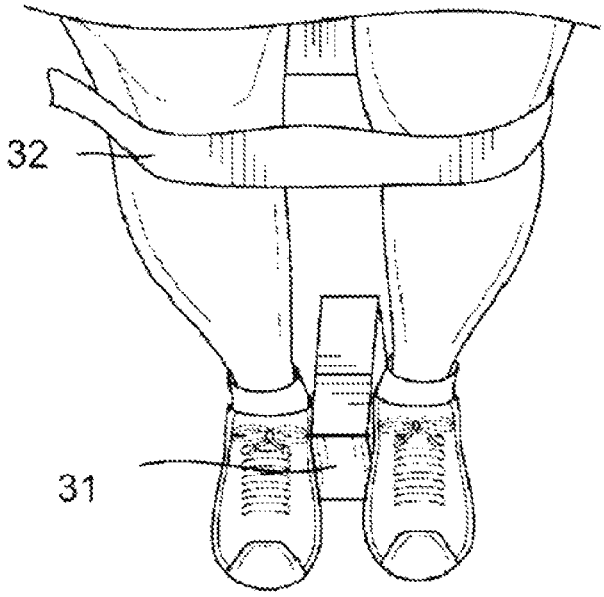
FIG. 4A is a diagram demonstrating a treatment of a bowleg medical condition including positioning a spacer 31 between the ankles of the subject and periodically tightening an adjustable strap 32 around the knees of the subject.

Referring to FIG. 4A, an exemplary treatment method for an individual suffering from a bowleg medical condition using the apparatus is as follows. Preferably the subject sits on a flat surface with legs extending outward during treatment. The spacer 31 is placed between the ankles and the adjustable strap 32 is secured generally around the knees. The adjustable strap 32 is then tightened over time. Most preferably, every few minutes the strap 32 is tightened slowly and carefully, making sure that the user does not experience major discomfort or pain, and the last tightening should be maintained for about 5 to 10 minutes. Afterwards, the strap 32 may be removed and with the spacer 31 still in position, the subject actively tightens the adductor muscle (inner groin) of the inner thigh to pull the thighs and knees together. Over time increased cartilage production may be found in the medial compartment of the knee, which would assist with its realignment.

Figure 4B:
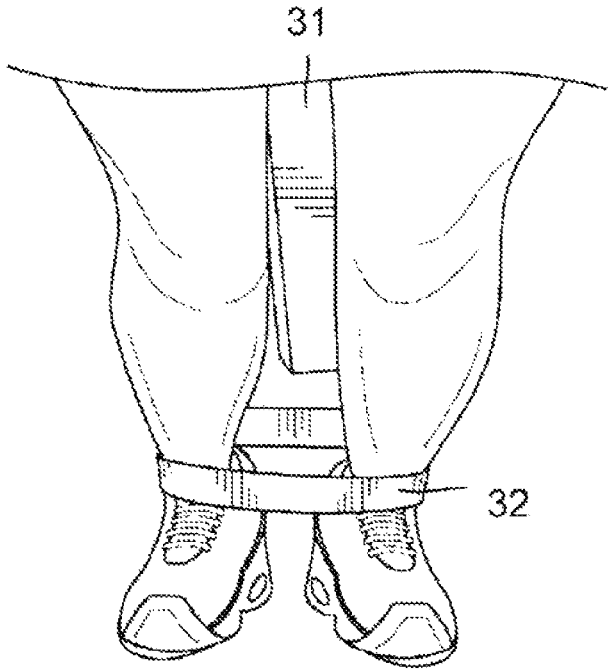
FIG. 4B is a diagram demonstrating a treatment of a knock-knee condition by positioning the spacer 31 between the knees of the subject and periodically tightening the adjustable strap 32 around the subject's ankles.

As indicated above, the device may also be used to treat knock-knee. An exemplary method is demonstrated in FIG. 4B. Preferably the subject sits on a flat surface with legs extending outward during treatment. The spacer 31 is placed between the subject's knees and the adjustable strap 32 is secured around the ankles. Preferably every few minutes the strap 32 is tightened slowly and carefully, making sure that the user does not experience major discomfort or pain, and the last tightening should be maintained for about 5 to 10 minutes. The subject may then remove the spacer 31 with the strap 32 still in position with legs straight as possible, and actively tighten the abductor muscles (hip muscle) of the outer thigh to pull the thighs and knees apart. Over time increased cartilage production may be found in the lateral compartment of the knee, which would assist with its realignment.

While the present invention provides methods for treating various conditions of the knee, it is believed mechanistically methods provided herein selectively optimize the joint environment for increase cartilage production within the medial compartment or lateral compartment of the human knee. Accordingly, this formation or stimulation of growth of cartilage or cartilage aggregates is believed to assist in the long term treatment of medical conditions affecting the knee. Although the exact mechanism may not be known. Increased cartilage production or increased presence of cartilage aggregates using the methods herein is consistent with the medical literature.

It is known that unloading weight bearing joints by surgical alteration in bone angles within the joint results in cartilage repair. This is known in hip surgery following osteotomy of the proximal femur for degenerative arthritis. D'Souza S R, Sadiz S, New A M R, Northmore-Ball M D. Proximal Femoral Osteotomy as the Primary Operation for Young Adults Who Have Osteoarthritis of the Hip. J Bone Joint Surg 80:1428-38 (1998).

Pathological studies on 535 patients hips undergoing total hip operations showed the potential for spontaneous cartilage repair in a painful hip that the patient was likely intentionally unloading during activities of daily living prior to definitive surgery. Milgram J W: Morphologic alterations of the subchondral bone in advanced degenerative arthritis. Clin Orthop 173:293-312, 1983.

Cartilage repair after unloading is not only found in large weight bearing joints such as the hip, but has also in the medial and lateral compartments within the knee. Long term evidence of such repair has been reported including gross and microscopic pathology. Coventry et al. J. Bone Joint Surg. 1985; 67A; 1136-1140 Kokino et al., Knee, 203; 10(3):229-36, Kanamiya et al., Journal of Arthroscopic and Related Surgery 18(7)725-729.

The amount of reduction in force is probably minimal as demonstrated by patient's spontaneous shifting weight to the painless total hip surgery side resulting in both cartilage repair and bone reformation according to Wolff's law on the untreated side. Many years of symptoms relief resulted. Histological study of the joint surfaces at subsequent surgery at 7 and 11 years provides biological evidence of the cartilage repair. Guyton et al., Clin Ortho Rel Res 2002, 404:302-7. This is consistent with studies showing that in some patients decreasing mechanical forces on degenerated joint surfaces stimulates formation of new biologic articular surface. Buckwalter J A, Biotechnology 2006; 43(3-4):603-9.

The repair is likely due to the presence of cartilaginous aggregates on even the most severe cartilage lesion, the Outerbridge IV lesion. Johnson et al., Arthroscopic Surgery; Principles and Practice. C. V. Mosby, St. Louis, Mo. (1986). Accordingly, the medical literature clearly demonstrates cartilage repair and increased presence of cartilage aggregates when unloading the affected joint or joint compartment. Other reports show the biological potential of the cartilaginous aggregates. Zhang D, Johnson L L, Hsu H P, Spector M. Cartilaginous deposits in subchondral bone in regions of exposed bone in osteoarthritis of the human knee: Histomorphometric study of PRG4 distribution in osteoarthritic cartilage. Journal of Orthopaedic Research. Volume 25, Issue 7, Date: July 2007: 873-883. This is supported by Milgram's report.

Methods of the present invention have the potential to increase production of cartilage or cartilage aggregates by correcting the abnormal angulation of the limb at the knee joint, which effectively unloads the joint. Accordingly, over time increased presence of cartilage aggregates in the unloaded compartment are likely to be found. When placing the spacer 31 between the knees and the adjustable strap 32 around the ankles, the lateral compartment is unloaded and thus the presence of cartilage aggregates will eventually increase in the lateral compartment of the knee. When placing the spacer 31 between the ankles and the adjustable strap 32 around the knees, the medial compartment is unloaded and thus the presence of cartilage aggregates will eventually increase in the medial compartment.

Figure 5:
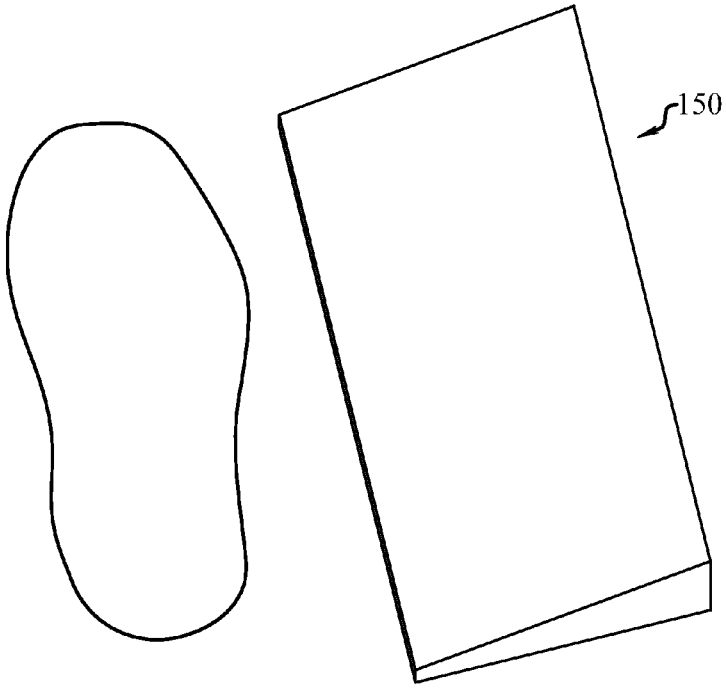
FIG. 5 is an outline of the right sided human foot, as seen from above, next to a wedge according to an embodiment of the present application.
Figure 6:
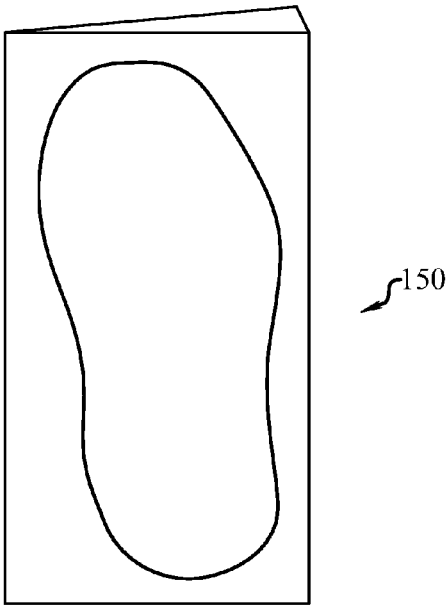
FIG. 6 is the outline of the right sided human foot overlaid on a wedge according to an embodiment of the present application, such that the lateral portion of the foot is elevated.
Figure 7:
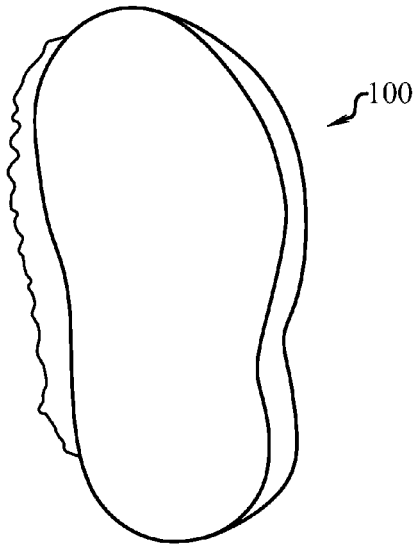
FIG. 7 is elevated perspective view of a right sided insole according to an embodiment of the present application, such that the lateral portion of the foot is elevated by the insole.
Figure 8:
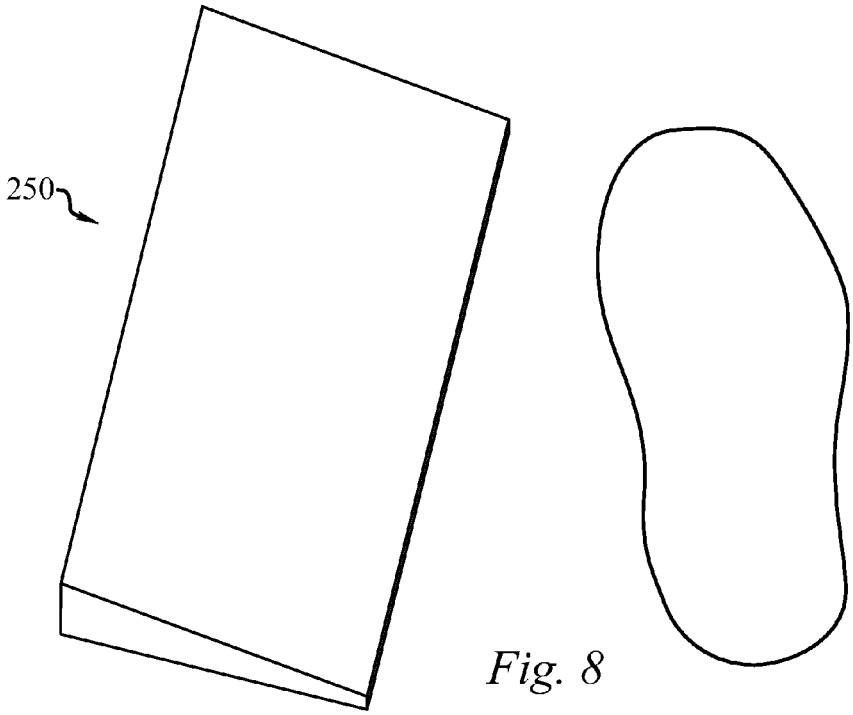
FIG. 8 is a wedge according to an embodiment of the present application next to an outline of the right sided human foot, as seen from above.
Figure 9:
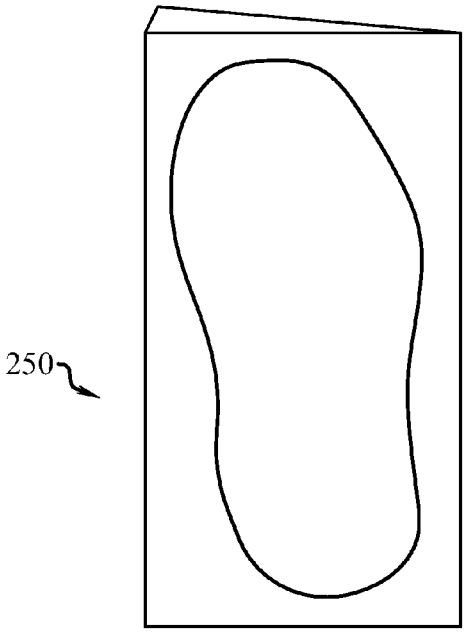
FIG. 9 is the outline of the right sided human foot overlaid on a wedge according to an embodiment of the present application, such that the medial portion of the foot is elevated.
Figure 10:
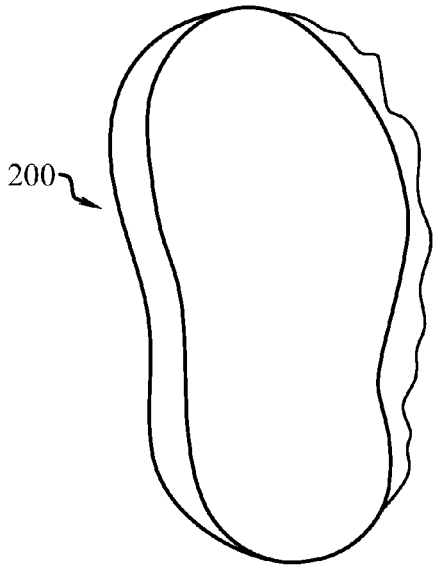
FIG. 10 is an elevated perspective view of a right sided insole according to an embodiment of the present application, such that the medial portion of the foot is elevated by the insole.

The potential for cartilage repair can be further increased by combining the treatment methods with those that unload the joint during ambulation. A preferred treatment includes combination with the use of cushioned wedged insoles (100, 200), as seen in FIGS. 5-10, in everyday ambulation, which cushion the joint from impact and selectively unload either the medial compartment or lateral compartment of the knee. Lateral wedges (100), seen well in FIG. 7, which include a raised lateral side, are chosen to selectively unload the medial compartment of the knee and thus are likely to be combined with a treatment for bowleg deformity. Medial wedges (200), seen well in FIG. 10, which include a raised medial side, are selected to unload the lateral compartment of the knee and thus are likely to be combined with a treatment for knock-knee deformity. Exemplary medial (200) and lateral (100)

wedges are those disclosed in U.S. patent application Ser. No. 12/603,160, entitled Prevention, Treatment and Rehabilitation of Injuries and Medical Conditions Affecting Weight-Bearing Joints Using Insoles that Alter Axial Forces, by Johnson; the contents of which, including the cushioned wedged slabs, insoles and chamber insoles for reducing or shifting axial forces and mediolateral forces are herein incorporated by reference. U.S. patent application Ser. No. 12/603,160 describes the ability of medial (250) and lateral (150) wedged slabs as seen in FIGS. 5-6 (lateral) and FIGS. 8-9 (medial) and insoles (100, 200) to selectively unload the lateral compartment and medial compartment of weight-bearing joints including the knee. Accordingly, when combined with methods herein the use of wedged slabs and insoles will enhance treatment of bowleg and knock-knee conditions, alter the peak axial loads across the knee joint and will assist in the production of cartilage or presence of cartilage aggregates.

When using a combined approach with cushioned wedged insoles (100, 200), the insole (100, 200) preferably extends from the subject's heel to at least midfoot and more preferably extends to the metatarsals. The cushioned wedged insole (100, 200) is constructed from a viscoelastic material, preferably a closed cell foam and most preferably ethylene vinyl acetate (EVA). Preferably the slope between the medial and lateral edges of the wedged insole (100, 200) is from about 2.5 degrees to about 5 degrees. Most preferably a 5 degree insole includes an edge of about 14 mm thick and an edge of about 4 mm thick. Most preferably a 2.5 degree insole includes an edge of about 7 mm thick and an edge of about 4 mm thick.

All headings are for the convenience of the reader and should not be used to limit the meaning of the text that follows the heading, unless so specified. Various changes and departures may be made to the present invention without departing from the spirit and scope thereof. Accordingly, it is not intended that the invention be limited to that specifically described in the specification or as illustrated in the drawings, but only as set forth in the claims. Although the invention has been described and illustrated with respect to exemplary embodiments thereof, it should be understood by those skilled in the art that the foregoing and various other changes, omissions, and additions may be made therein and thereto, without parting from the spirit and scope of the present invention.

What is claimed is:

1. A kit for the treatment or rehabilitation of medical conditions of the human knee, comprising:

a) an apparatus which is interchangeable between a first configuration for passive exercise of the human knee and a second configuration for active exercise of the human knee and comprises:

i) a substantially rigid support member comprising two substantially similar sides joined at an apex and at opposing ends by a third side, wherein the third side comprises a lengthwise extending cavity positioned about the center and two linearly aligned flanking surfaces extending the entire width of the member, wherein the flanking surfaces provide regions for resting both the proximal and distal ends of a subject's leg when one of the two substantially similar sides contacts a ground surface in the first configuration and are capable of acting as a stand when the third side contacts a ground surface in the second configuration, and ii) at least two adjustable straps;

b) a spacer capable of being placed between the legs of a subject and capable of resisting compression during tightening of one of the adjustable straps around the subject's legs; and c) a wedged insole for the subject's shoe, wherein the wedged insole comprises a raised lateral side or raised medial side.

2. The kit according to claim 1, wherein the apex comprises an angle of about 130 degrees.

3. A method for passive realignment of a bowleg deformity in a subject, comprising the steps of:

(A) during a first time period, a) sitting on a substantially flat surface with legs extending outward;

b) providing a spacer capable of being placed between the legs of a subject;

c) placing the spacer between the ankles of the subject;

d) securing single adjustable strap around both knees, wherein there is no intervening object between the knees;

e) tightening the strap sequentially over a period of time such that the knees are gradually brought inward toward each other; wherein the spacer resists compression during the tightening of the strap; and (B) during a second time period not overlapping the first time period, f) wearing a wedged insole in a shoe while walking, wherein the wedged insole comprises a raised lateral side.

4. The method according to claim 3, wherein the tightening is maintained at the end of each session from 5 to 10 minutes.

5. The method according to claim 3, further comprising removing the strap and actively tightening the inner groin muscles of the thigh thereby pulling the knees together.

6. A method for passive realignment of a knock-knee deformity in a human subject, comprising the steps of:

(A) during a first time period, a) sitting on a substantially flat surface with legs extending outward;

b) providing a spacer capable of being placed between the legs of a subject;

c) placing the spacer between the knees of the subject;

d) securing a single adjustable strap around both ankles of the subject, wherein there is no intervening object between the ankles; and e) tightening the strap sequentially over a period of time such that the ankles are gradually brought inward toward each other; wherein the spacer resists compression during the tightening of the strap; and (B) during a second time period not overlapping the first time period, f) wearing a wedged insole in a shoe while walking, wherein the wedged insole comprises a raised medial side.

7. The method according to claim 6, wherein in step d), the last tightening of each session is maintained from 5 to 10 minutes.

8. The method according to claim 6, further comprising removing the spacer and actively tightening the hip outer muscles of the thigh thereby pulling the knees apart.

9. A method for regaining or maintaining knee joint motion in a human subject, comprising the steps of:

a) providing a kit comprising a wedged insole for a shoe comprising a raised lateral side or a raised medial side, and apparatus which is interchangeable between a first configuration for passive exercise of the human knee and a second configuration for active exercise of the human knee:

i) a substantially rigid support member comprising two substantially similar sides joined at an apex and at opposing ends by a third side, wherein the third side comprises a lengthwise extending cavity positioned about the center and two linearly aligned flanking surfaces extending the width of the member, wherein the flanking surfaces provide regions for resting both the proximal and distal ends of a subject's leg in the first configuration and are capable of acting as a stand in the second configuration, and ii) at least two adjustable straps; and (A) during a first time period, b) positioning the apparatus in the first configuration such that one of the two substantially similar sides contacts a ground surface;

c) placing the subject's leg lengthwise across the cavity and contacting each of the flanking surfaces of the third side;

d) securing each of two straps around the subject's leg and the rigid support member, wherein the first strap is positioned around the thigh and the second strap is positioned around the shin or ankle;

e) progressively tightening the two straps over time; and (B) during a second time period not overlapping the first time period, f) wearing the wedged insole while walking.

10. The method of claim 9, wherein progressive tightening occurs every few minutes and the position is maintained at the end of each session for up to 10 minutes.

11. A method for increasing knee flexibility and strengthening of the quadriceps muscles comprising:

a) providing a kit comprising a wedged insole for a shoe comprising a raised lateral side or a raised medial side, and an apparatus which is interchangeable between a first configuration for passive exercise of the human knee and a second configuration for active exercise of the human knee and comprises:

i) a substantially rigid support member comprising two substantially similar sides joined at an apex and at opposing ends by a third side, wherein the third side comprises a lengthwise extending cavity positioned about the center and two linearly aligned flanking surfaces extending the width of the member, wherein the flanking surfaces provide regions for resting both the proximal and distal ends of a subject's leg in the first configuration and are capable of acting as a stand in the second configuration, and ii) at least two adjustable straps; and (A) during a first time period, b) positioning the apparatus in the first configuration such that one of the two substantially similar sides contacts a ground surface;

c) placing the subject's leg lengthwise across the cavity and contacting each of the flanking surfaces of the third side;

d) securing each of two straps around the subject's leg and the rigid support member, wherein the first strap is positioned around the thigh and the second strap is positioned around the shin or ankle;

e) periodically tightening the two straps over time;

f) positioning the apparatus in the second configuration such that the third side contacts the ground surface;

g) placing the subject's leg along the rigid support member such that the back of the knee is positioned over the apex;

h) securing one of the adjustable straps around the shin or ankle and the rigid support member; and i) the subject periodically and repeatedly raising the foot to tighten the quadriceps muscles followed by lowering the foot to relax the quadriceps muscles; and (B) during a second time period not overlapping the first time period, j) wearing the wedged insole while walking.

* * * * *